US005586796A

United States Patent [19]

Fraser

[11] Patent Number: 5,586,796

[45] Date of Patent: Dec. 24, 1996

[54] REINFORCING DEVICES FOR DOORS AND DOOR FRAMES

[76] Inventor: Paul E. Fraser, 501, Valcartier, Loretteville, Quebec, Canada, G2A 2N6

[21] Appl. No.: 393,924

[22] Filed: Feb. 21, 1995

Related U.S. Application Data

[63] Continuation of Ser. No. 998,461, Dec. 30, 1992, abandoned.

[30] Foreign Application Priority Data

Dec. 30, 1991 [CA] Canada ..... 2058615

[51] Int. Cl.[6] ..... E05B 17/00

[52] U.S. Cl. ..... 292/346; 292/340; 292/357; 70/416

[58] Field of Search ..... 292/340, 346, 292/357; 70/452, 416

[56] References Cited

U.S. PATENT DOCUMENTS

| | | |
|---|---|---|
| 1,010,365 | 11/1911 | Hensle . |
| 1,500,168 | 7/1924 | Voight . |
| 1,791,029 | 2/1931 | Hurd . |
| 3,767,245 | 10/1973 | Keefe . |
| 4,139,999 | 2/1979 | Allenbaugh . |
| 4,295,299 | 10/1981 | Nelson . |
| 4,415,191 | 11/1983 | Thorp . |
| 4,484,463 | 11/1984 | Hennessy . |
| 4,671,089 | 6/1987 | Fleming et al. . |
| 4,717,185 | 1/1988 | Hartley . |
| 4,809,400 | 3/1989 | Allen . |
| 4,854,622 | 8/1989 | Lozano . |
| 4,862,658 | 9/1989 | Barker et al. . |
| 4,887,856 | 12/1989 | Percoco et al. . |
| 4,993,764 | 2/1991 | Barker . |
| 5,024,475 | 6/1991 | Francis . |
| 5,031,946 | 7/1991 | Yarrow . |
| 5,088,780 | 2/1992 | Doherty . |
| 5,154,461 | 10/1992 | Prescott et al. . |

FOREIGN PATENT DOCUMENTS

| | | | |
|---|---|---|---|
| 1032985 | 6/1978 | Canada . | |
| 2755961 | 6/1979 | Germany . | |
| 3124627 | 1/1983 | Germany . | |
| 3604719 | 8/1987 | Germany . | |
| 469169 | 4/1969 | Switzerland | 292/336.3 |

*Primary Examiner*—Rodney M. Lindsey
*Attorney, Agent, or Firm*—Swabey Ogilvy Renault

[57] ABSTRACT

The present invention relates to a system for reinforcing door frames and doors, and in particular to a unit including twin plates which are joined one to the other transversely through the door and which are positioned on the outside and on the inside of the door to reinforce the same at the level of the handle, the latch and the dead bolt. An inner plate is also proposed which is hidden in the door frame to reinforce the same at the level of the dead bolt. The hidden plate is installed on the exterior of a new door frame and it includes as an appendix a projecting collar which extends through the door frame and which is adapted to surround the dead bolt in the door frame; the hidden plate mounted in a previously installed door frame which is provided with a weather-strip has the shape of a "S" and is installed in the groove which normally receives the weather-strip by taking up the place of a section of this weather-strip, and by also extending to the location of the striking plate at which point the plate defines also an opening which allows it to surround the dead bolt.

20 Claims, 12 Drawing Sheets

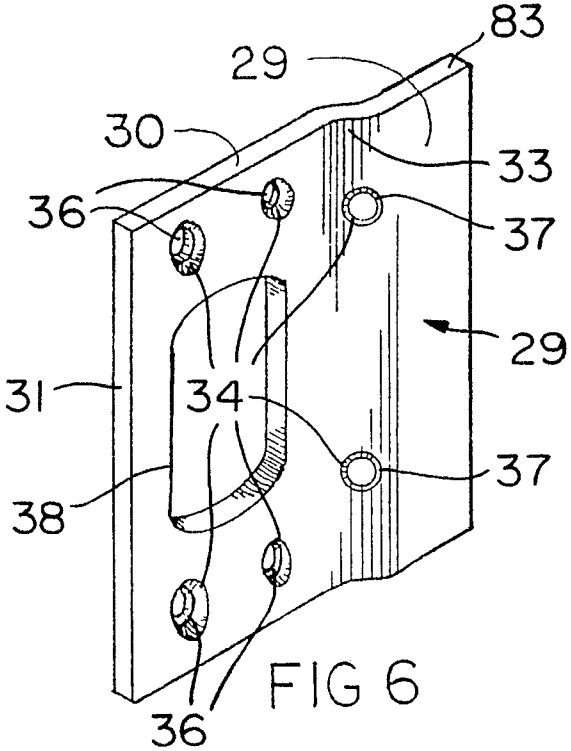
FIG 6
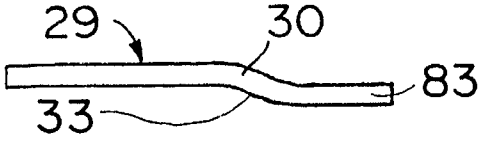
FIG 8
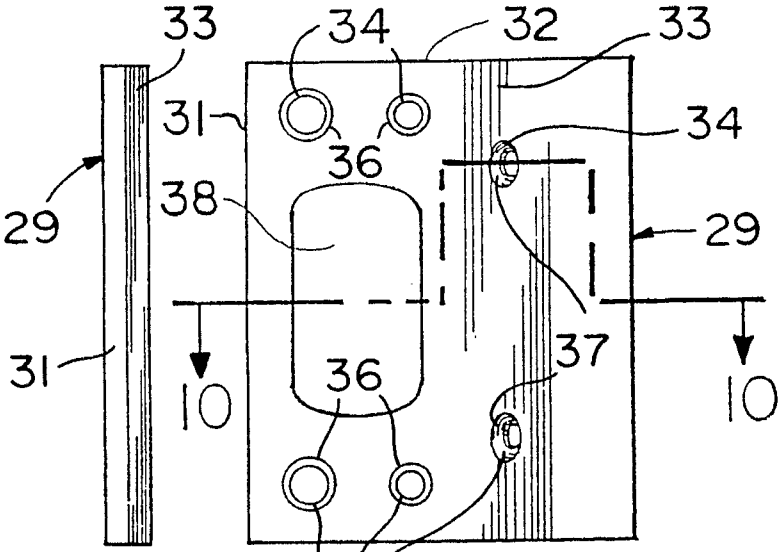
FIG 7
FIG 9

REINFORCING DEVICES FOR DOORS AND DOOR FRAMES

This application is a continuation of application Ser. No. 07/998,461 filed on Dec. 30, 1992, now abandoned.

BACKGROUND OF THE INVENTION

1. Field of the Invention

The present invention relates to plates adapted for reinforcing standard wooden door frames used in private homes-For steel doors with inner wooden body, the present invention relates also to reinforcing plates to be located in the vicinity of the bolt of the lock. The combination of the reinforced door frames and doors renders theft by breaking in through the door almost impossible.

2. Description of the Prior Art

The door frames are generally manufactured with soft wood, from coniferous trees such as the western cedar or the pine, the latter breed being the most popular. These frames are advantageous in that they are economical, easy to shape, and do not necessitate specialized tools and labor for their installation. However, they are disadvantageously sensitive to wear resulting from friction; they are flexible under torsion when forces are applied thereon in the horizontal direction of their fiber components and in the medium term they can split along their length. This is the result of the natural drying of the fibers which tend to separate; this last phenomena can, for instance, be observed on beams or planks made of oven-dried pine. These door frames are particularly vulnerable to break-ins during thefts since, as mentioned hereinabove, they are flexible at their center, that is the wood piece that constitutes them has an optimal force if it is pushed from the front or from behind, but has limited force if subjected to a swiping lateral thrust. This is due to the nature of the wood, that is to the orientation of the wood grain. Thus, to overcome this deficiency, we must look to reinforce the wood. This can be done by adding on the surface of the wood or by introducing in the wood rigid plates which will assist the wood in its work without hampering or altering the intrinsic qualities thereof. Moreover, the plates add to the door frame the necessary resistance to torsion when a lever is used to force the door and this at a relatively low cost with respect to the efficiency which is obtained.

For residential steel doors, it is necessary to reinforce the door, because the handle, the latch and the bolt are weakly connected by a casing made of a thin and non-structural metal, say of a soft wood frame. The prior art reveals amongst others two Patents having similarities with respect to the reinforcement systems that I have conceived. U.S. Pat. No. 1,010,365 discloses a S-shaped plate acting as a closing latch and mounted on the surface of the door as a movable S-shaped part. The use thereof was different and in relation with the type of closure used at that time. These S-shaped parts were mounted on the surface of the door, whereas in my system the S-shaped plate is hidden in the door frame and is fixed thereto, and the dead bolt is received in my S-shaped plate which is located on the inside of the door frame thereby constituting a whole or unit which is a lot more resistant.

As for U.S. Pat. No. 5,031,946, there is disclosed therein a reinforcing plate for a door which includes protruding rods and which is in fact a L-shaped reinforcing system having a double latch with one side of the "L" being mounted at the surface of the door without an adhesive contact with this surface, while its other side has adherence rods fixed internally in the door. This system does not take into consideration the handle and it can only be used on one side of the door, meaning that it can reinforce the door on only one of its sides. Finally, it is not much protected against torsion and thus it is subject to be dislodged by jamming.

SUMMARY OF THE INVENTION

It accordance with a first construction in accordance with the present invention, a first plate is used for reinforcing new door frames which have been manufactured but not installed. A method for reinforcing the door frame uses the first plate which is rigid and which comprises a projecting first collar adapted to surround the bolt, but the method is inconvenient in that the first plate must be installed on the door frame before its installation in a wall adapted to receive a door. That is why I have designed, in accordance with a second construction in accordance with the present invention, a device for reinforcing the door frame which can join the first collar while being solidly mounted on the inside of an already installed door frame and which can provide a second receiving collar for the bolt, the device comprising a second plate comprising a second collar, the second plate being adapted to be mounted in a plurality of directions in the wood of the door frame while being able to use a groove of a weather-strip for orienting the second plate.

Therefore, in accordance with the present invention, there is provided a reinforcement device for a door, the door comprising interior and exterior parallel surfaces and also comprising at least one door control device of at least one bolt, dead or live, the bolt extending through a side of the door joining the two previous parallel surfaces thereof, the reinforcement device comprising a pair of distinct inner and outer reinforcing plates adapted to be positioned substantially opposite one to the other respectively on the interior and exterior surfaces of the door and close to the side of the door carrying the bolt, each one of the plates defining at least a first opening intended to surround the control device of the bolt, stress means being provided for urging the plates one towards the other, the stress means extending through the door substantially along the thickness thereof, the reinforcement device thus reinforcing the door at least around the bolt.

Also in accordance with the present invention, there is provided a reinforcement device for a door frame, the door frame being located inside of an opening defined in a wall, a location for a striking plate being defined in the door frame for receiving at least a bolt of a door, the reinforcement device comprising a plate adapted to be secured against a surface of the door frame facing the door when the latter is closed, the plate comprising opposite the location of the striking plate an opening intended for surrounding the bolt, securing means being provided for securing the plate to the door frame, the securing means being adapted for being directed transversely in the door frame, the reinforcement device being characterized in that the plate comprises an extension adapted for extending substantially at least up to a section of the door frame where join a first surface of the door frame defining the location of the striking plate and a second surface of the door frame which limit the displacement of the door when it is displaced towards its closed position, the extension being thus adapted to be located between the location of the striking plate and at least the second surface of the door frame, anchoring means being adapted to extend through the extension at an angle with respect to the first surface mentioned previously and for then extending through the door frame in such a way as to finally become anchored in a framework of the wall, thus rendering the door frame substantially interdependent of the wall.

Further in accordance with the present invention, there is provided a reinforcement device for a door frame comprises a plate and a substantially oval collar secured to the plate, the plate being adapted for being mounted on an exterior surface of the door frame prior to the installation of this door frame inside an opening defined in a wall in such a way that the collar project from the plate in the direction of a door and extends at least partly through the door frame, the collar being adapted to receive a bolt of the door when the latter is closed, thereby reinforcing the door frame.

BRIEF DESCRIPTION OF THE DRAWINGS

Having thus generally described the nature of the invention, reference will now be made to the accompanying drawings, showing by way of illustration a preferred embodiment thereof, and in which:

FIG. 6 is a perspective view of the second plate of FIG. 1, that is the S-shaped plate;

FIG. 7 is an elevational view of the S-shaped plate of FIG. 6;

FIG. 8 is a top plan view of the S-shaped plate of FIG. 7;

FIG. 9 is a left side view of the S-shaped of FIG. 7;

DESCRIPTION OF THE PREFERRED EMBODIMENTS

Figure 1:
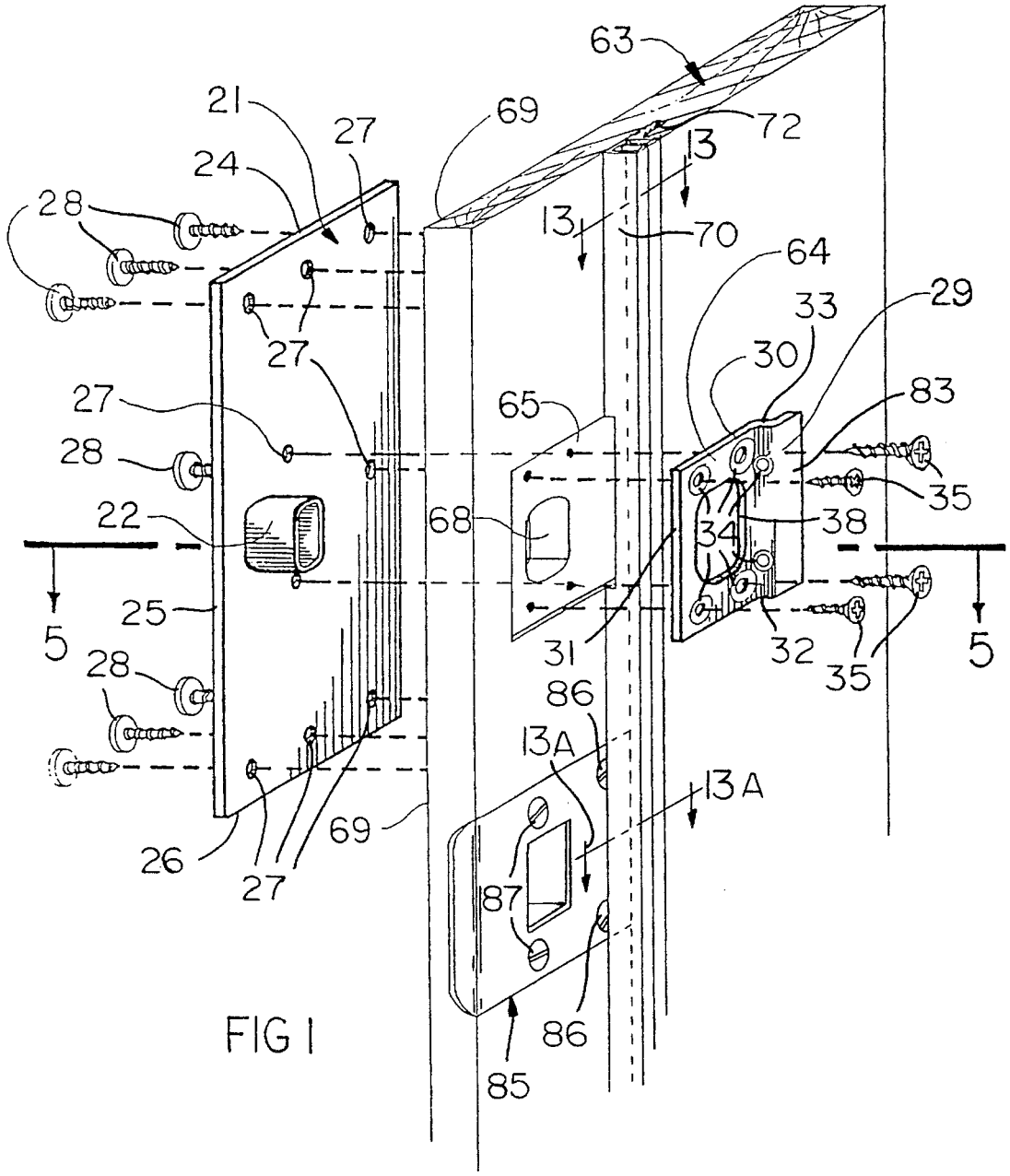
FIG. 1 is an exploded perspective view of a device for reinforcing a door frame joining a first plate having a protruding collar and comprising also a S-shaped plate in accordance with first and second embodiments of the present invention, respectively.
Figure 4:
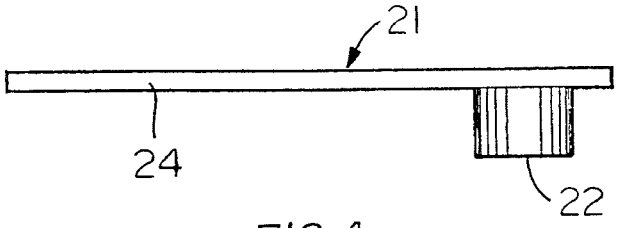
FIG. 4 is a top plan view of the plate of FIG. 2.
Figure 2:
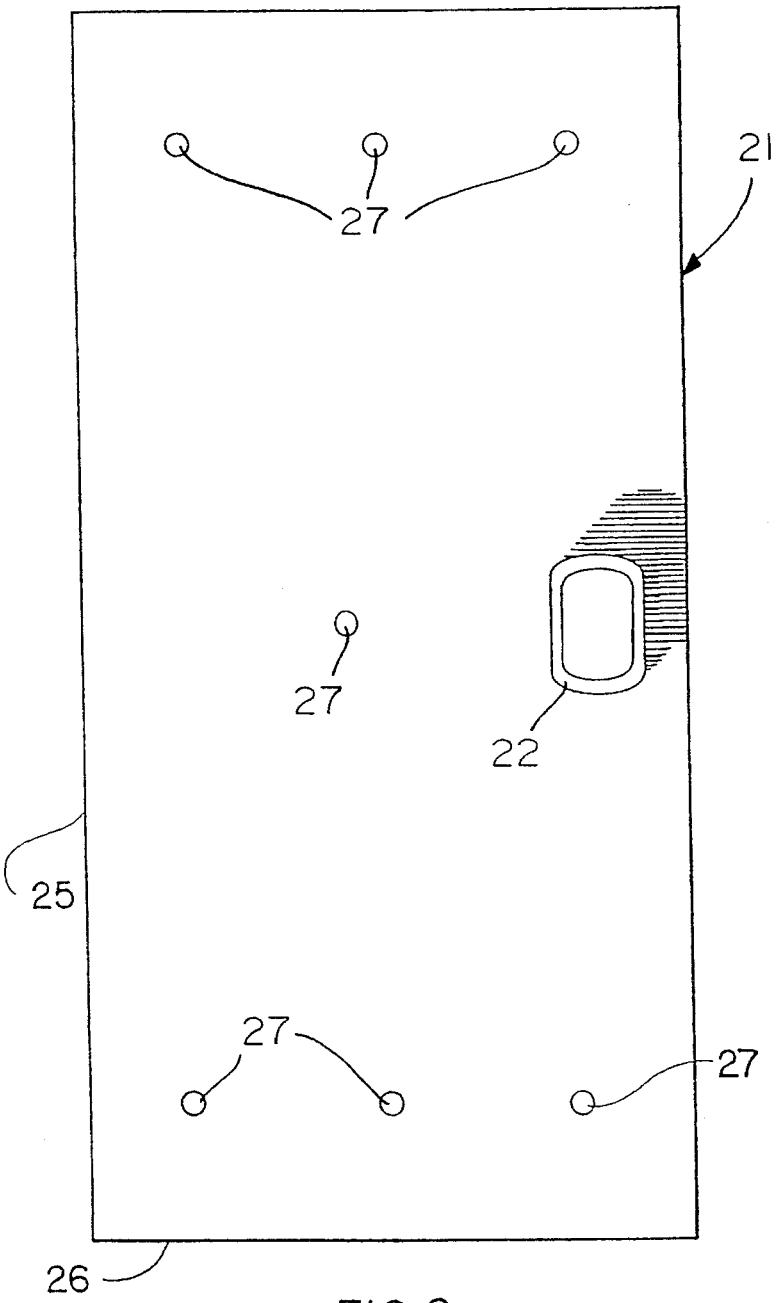
FIG. 2 is an elevational view of the first plate of FIG. 1.
Figure 3:
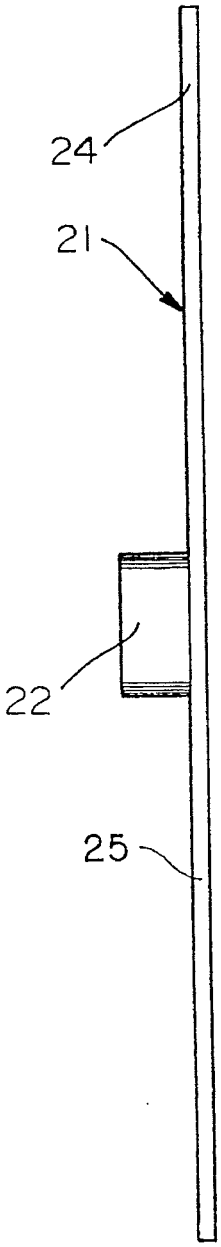
FIG. 3 is a right-side view of the plate of FIG. 2.

With reference to the annexed drawings wherein the same numerals refer to the same elements, a plate 21 in accordance with a first embodiment of the present invention and having a projecting collar 22 is made from a uniform and smooth steel piece having a thickness 24 approximately of 0.035 inch. Typically, the dimensions of the plate 21 are: a length 25 (FIG. 2) of 10 inches and a width 26 of 4 inches. The plate 21 is perforated with seven circular countersunk holes 27 intended to receive countersunk screws 28 (FIG. 1). The projecting collar 22 of the plate 21 comprises an oval-shaped steel appendix for receiving a dead bolt. The collar 22 is solidly mounted to the plate 21 by way of any technically acceptable means and is positioned typically at the longitudinal center of the plate 21, with a distance of 1 inch separating the center of the collar 22 from one of the longitudinal edges of the plate 21 and with a distance of 4.35 inches separating the side of the collar 22 from the transversal upper edge of the plate 21.

Figure 15:
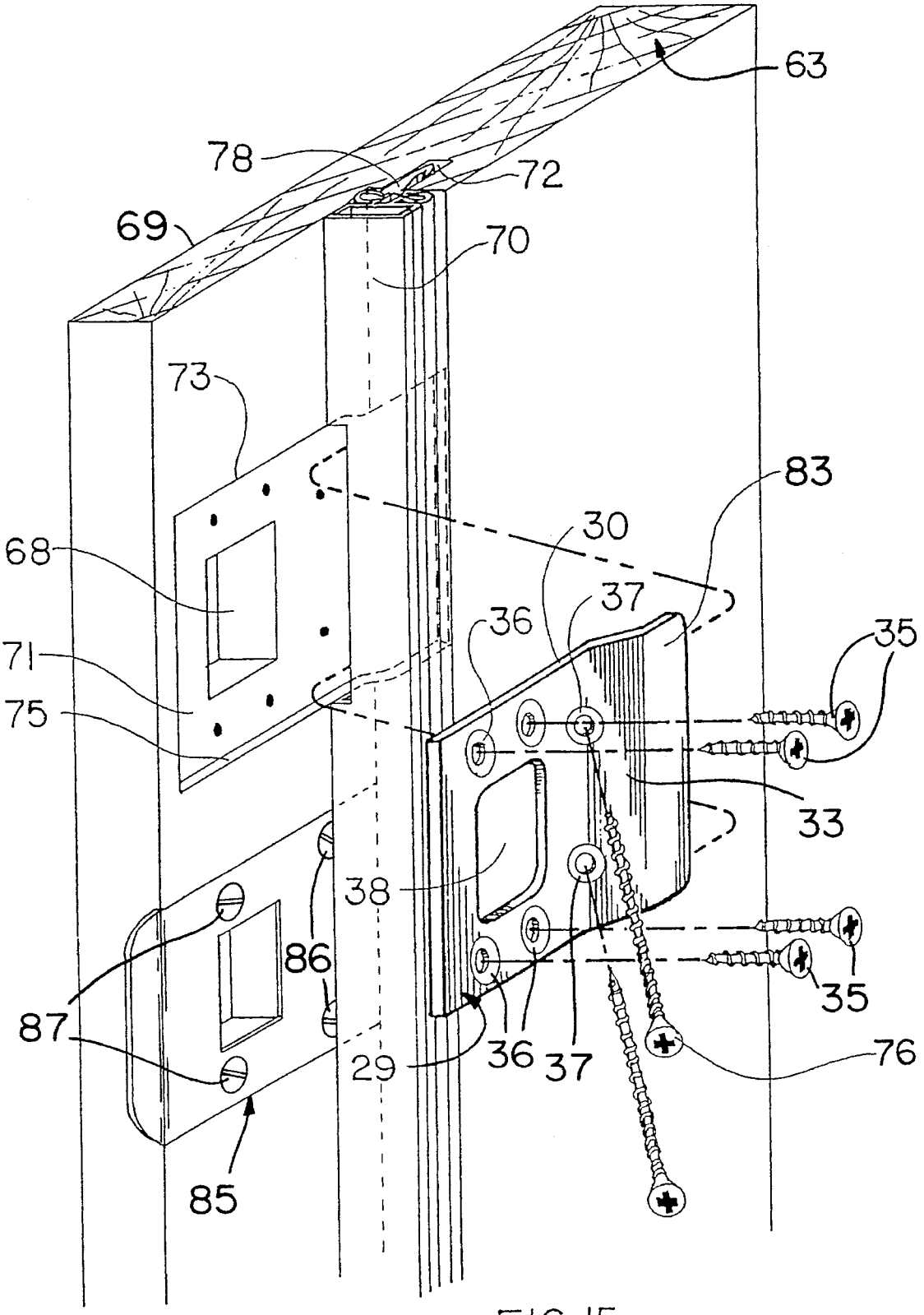
FIG. 15 is an exploded perspective view of the S-shaped plate of FIG. 6, in use.

A S-shaped plate 29 in accordance with a second embodiment of the present invention is manufactured from a smooth and uniform steel piece having a thickness of approximately 0.085 inch. Typically, the S-shaped plate 29 has the following dimensions: a length 31 (FIG. 7) of 2.75 inches with a width 32 of 2.50 inches. The plate 29 has the shape of a "S" at 33 (FIG. 8) along its longitudinal orientation. There are defined on the S-shaped plate 29 seven holes: six of these holes noted 34 are circular and countersunk and are intended for receiving countersunk screws 35 and 76 (FIG. 15). Four of these holes 34 noted 36 are located on a first forward and plane section of the S-shaped plate 29; the other two holes 36 noted 37 are located at the beginning of the deflection or elbow section of the S-shaped plate 29 for allowing the screws 76 to be diagonally threaded through a door frame. A last hole 38 which is oval-shaped is defined on a front portion of the S-shaped plate 29. The hole 38 acts as a collar for retaining a bolt 81, such as a dead bolt.

Figure 11:
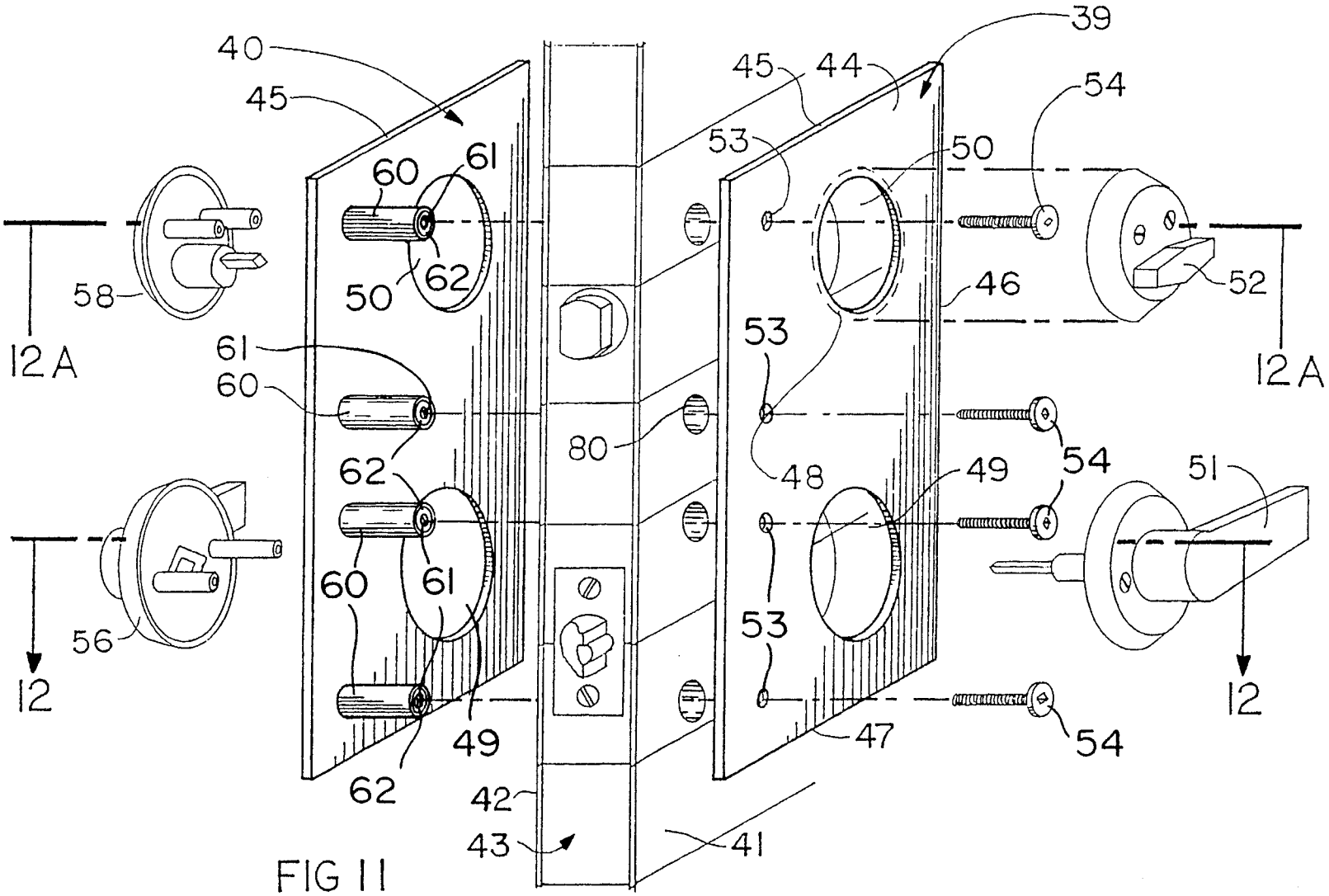
FIG. 11 is a perspective view of a set of twin plates for doors in accordance with a third embodiment of the present invention.

The twin plates of FIG. 11 in accordance with a third embodiment of the present invention are constituted of two plates 39 and 40 located face to face, one on the interior surface 41 of a door 43 and the other on an exterior surface 42 thereof, respectively. The plate 39 is made of a uniform and smooth metal 44 having approximately a thickness 45 of 0.085 inch. Typically, the dimensions of the plate 39 are as follows: a length 46 of 10 inches and a width 47 of 4 inches. The plate 39 is perforated with six circular holes, two of these holes noted 49 and 50 are intended for receiving a handle 51 of the door 43 and a latch 42 of the door 43, the holes 49 and 50 being smaller than a projection 48 of the bases of the handle 51 and of the latch 52. The four other holes 53 are intended for receiving mounting screws 54. The plate 40 is made from a uniform and smooth steel plate having the same thickness and dimensions as the plate 39. The plate 40 also defines two holes intended for receiving the other side 56 of the handle 51 and a key lock 58 of the door 43 which is located opposite the latch 42 but on the other side of the door 43. Four pillars 60 which are internally threaded at 61 and which each include an inner thermally insulating sleeve 62 project from the plate 40 and are fixedly mounted thereto using any technically acceptable means. The sleeves 62 prevent any conductive contact between the pillars 60 and the mounting screws 54. The four mounting screws 54 complete the unit.

In individual use, the plate 21 having the projecting collar 22 is installed, for instance, on a door frame of a new steel or wooden door when a security door latch is intended to be used. The plate 21 can be installed in the plant during the manufacture of the door frame or can be installed just prior to the mounting to a wall of the unit made up of the door and of the door frame.

Figure 5:
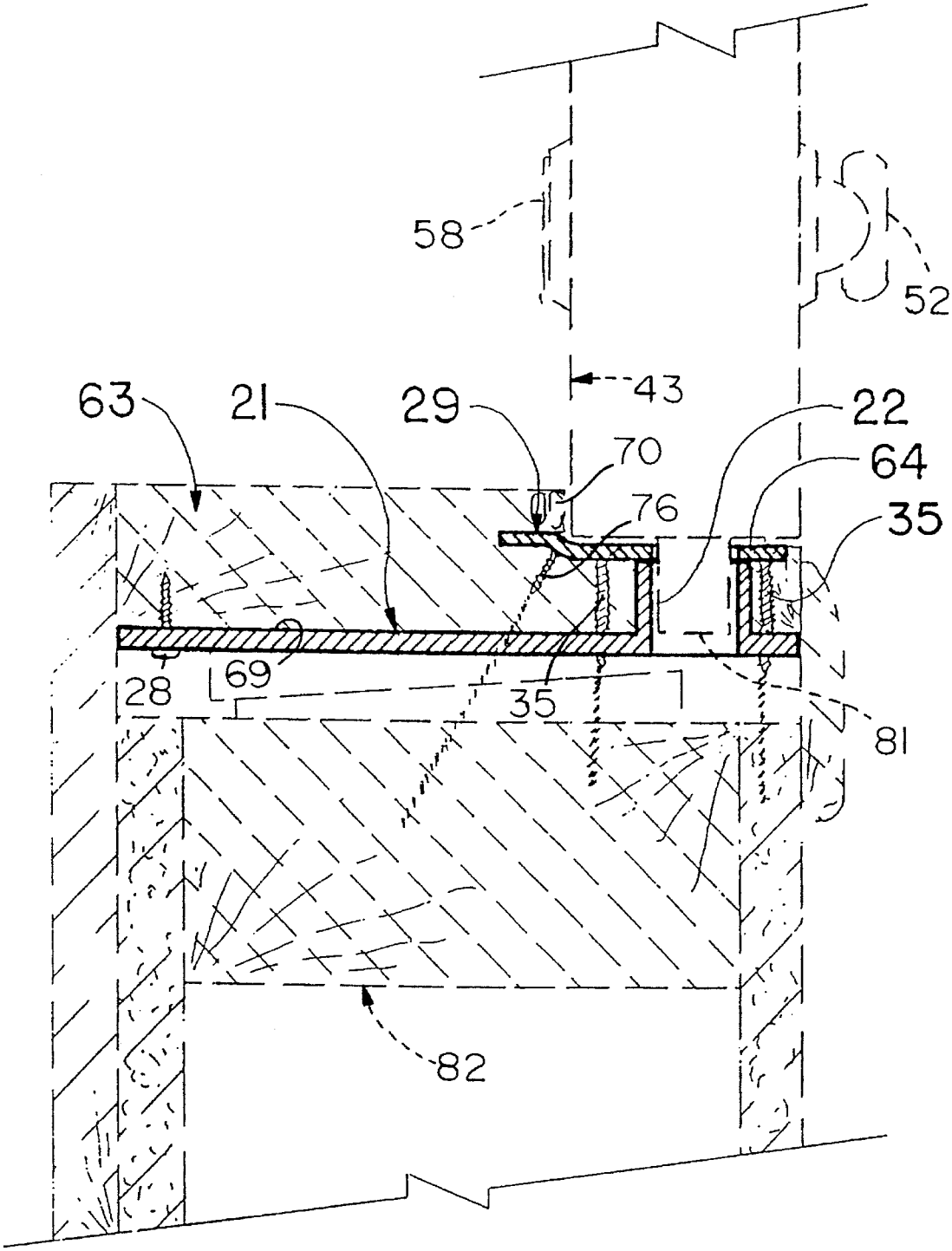
FIG. 5 is a horizontal cross-section taken along lines 5—5 of FIG. 1.
Figure 13:
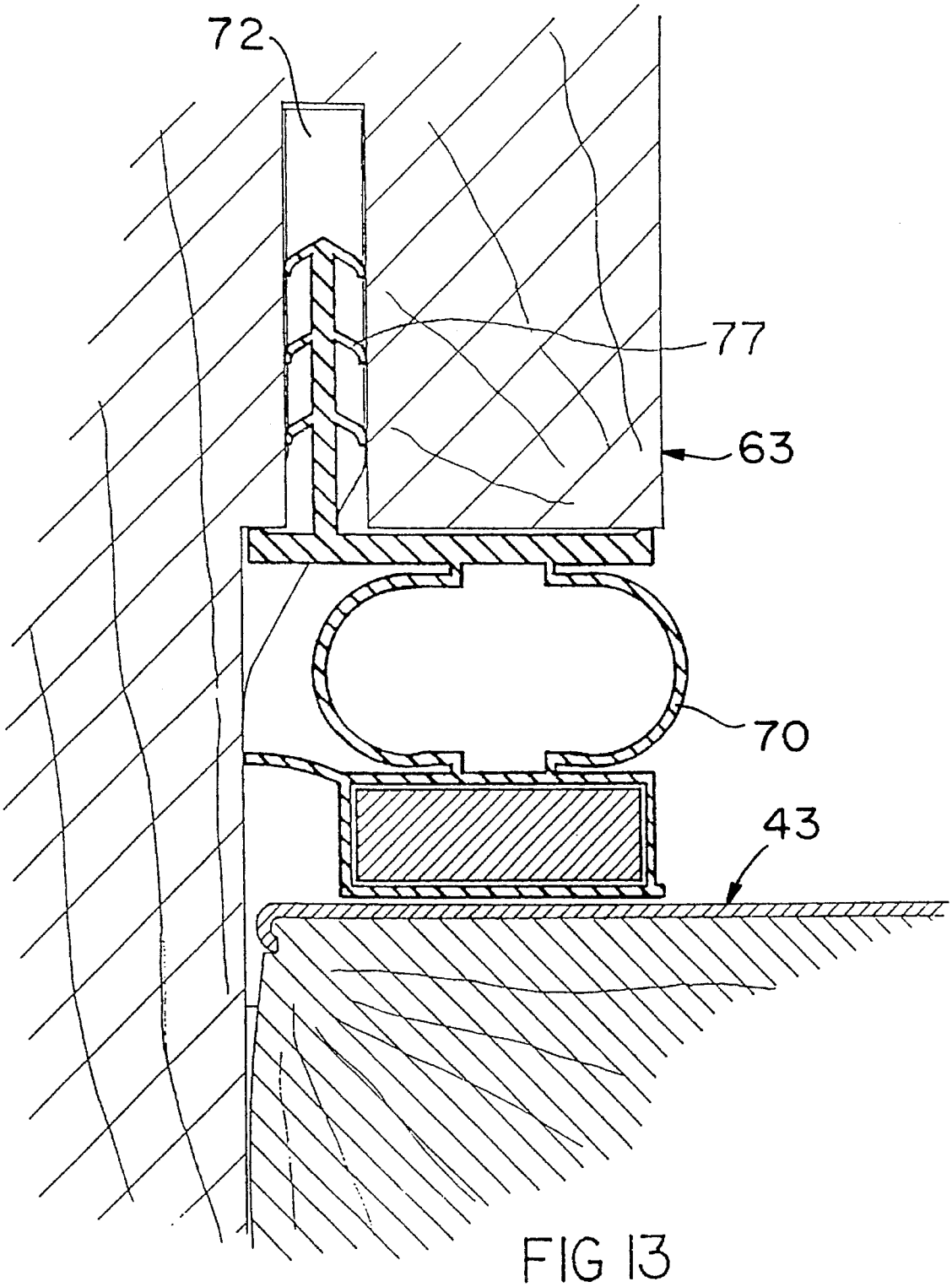
FIG. 13 is a horizontal cross-section taken along lines 13—13 of FIG. 1 and illustrating a weather-strip in position in a door frame with a door in closed position being further shown therewith.
Figure 14:
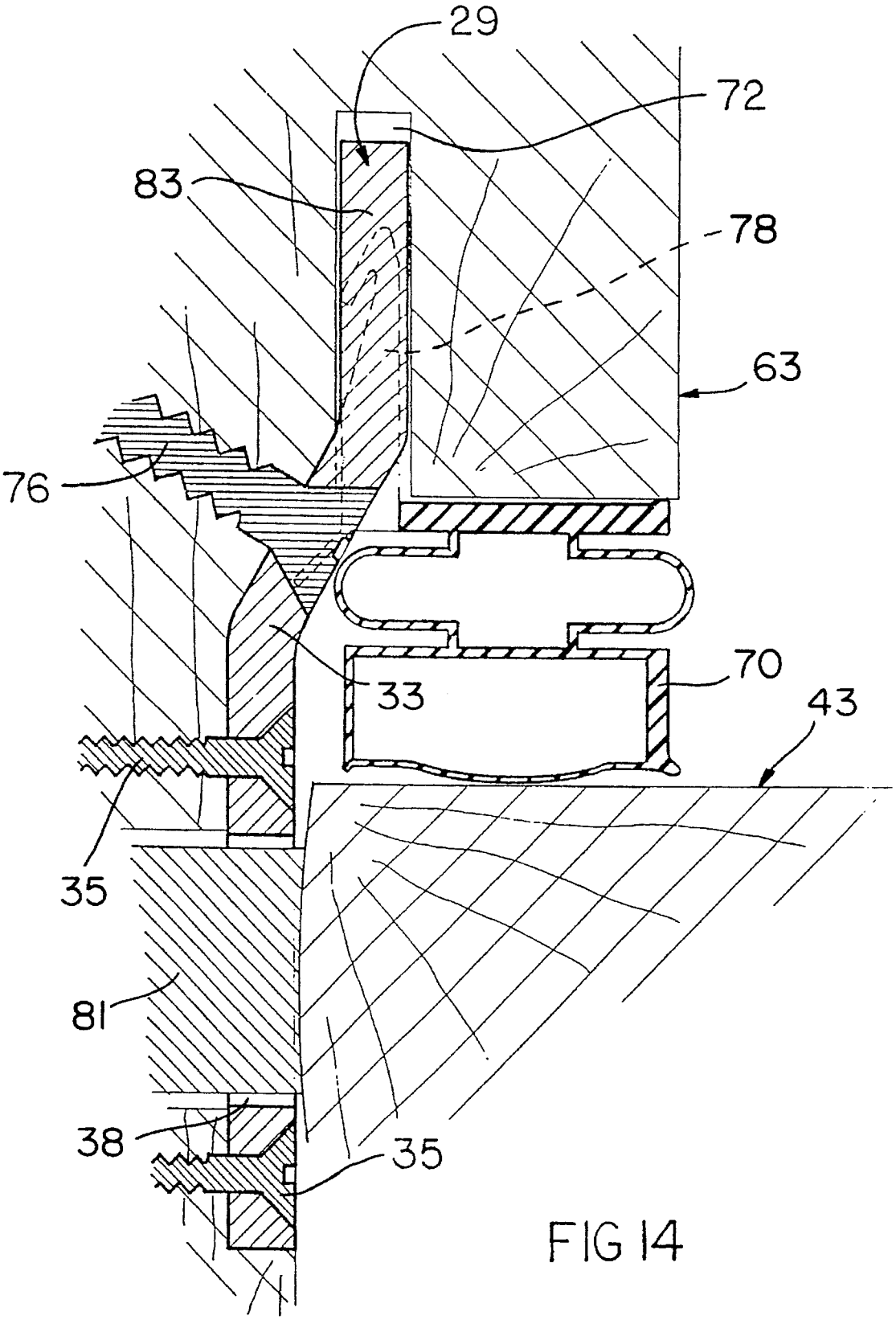
FIG. 14 is an enlarged horizontal cross-section similar to FIG. 10, but showing the full plate of FIG. 6, with the inserted S-shaped plate having taken up the place of part of the weather-strip.

To only install the S-shaped plate 29, it is required to first remove any striking plate 64 originally provided on the door frame 63 (FIG. 5); then, the weather-strip 70 must be at least partly removed (FIG. 15) from the door frame 63. It is essential that the diagonal mounting screws 76 be installed in the holes 37 (FIG. 15) in order that a tail 83 (FIG. 8) of the S-shaped plate 29 can be located in the groove receiving the weather-strip 70 (FIG. 14). If the door frame 63 does not have a striking plate, it is then required to determine the location 71 (FIG. 15) on the door frame 63 for the S-shaped plate 29. In order to do so, the S-shaped plate 29 is positioned at a regulation height from the door step and at a regulation distance from the interior edge of the door frame. Once this location 71 has been determined, the S-shaped plate 29 is introduced in a groove 72 defined in the door frame 63 and which receives the weather-strip 70. If the door frame 63 already had a striking plate, the same location is used to position the S-shaped plate 29. Using a pencil, a visible outline 73 of the S-shaped plate 29 is traced on the door frame 63 and a oval hole 68 is then drilled in the door frame 63 with a tool, the oval hole 68 being adapted for corresponding to the oval hole 38 of the S-shaped plate 29. Then, a recess 75 is defined in the door frame 63 within the outline 73, the recess 75 having a depth equal to the thickness 30 of the S-shaped plate 29. The same operation was repeated for defining the oval hole 68. Then, the S-shaped plate 29 is introduced in the recess 75 and is mounted to the door frame 63 with the mounting screws 76 (FIGS. 14 and 15) which engage the diagonally oriented circular holes 37. The same operation is repeated for the screws 35 which engage the circular holes 36, the screws 35 being threaded transversely into the door frame 63 and being used to center the S-shaped plate 29. Finally, before reintroducing the weather-strip 70 in the groove 72, it is preferable to remove a section of the anchor or hook 77,78 (FIGS. 13 and 14) of the weather-strip 70 opposite the groove 72 which is occupied by the S-shaped plate 29. The S-shaped plate 29 of FIG. 6 is particularly intended for residential steel doors, since these doors include a magnetic weather-strip and the corresponding door frame defines a groove for receiving this weather-strip, whereas the wooden doors with corresponding wooden door frames do not generally include weather-strips nor are grooves defined in the door frames as surface weather-strips are used instead.

Figure 12:
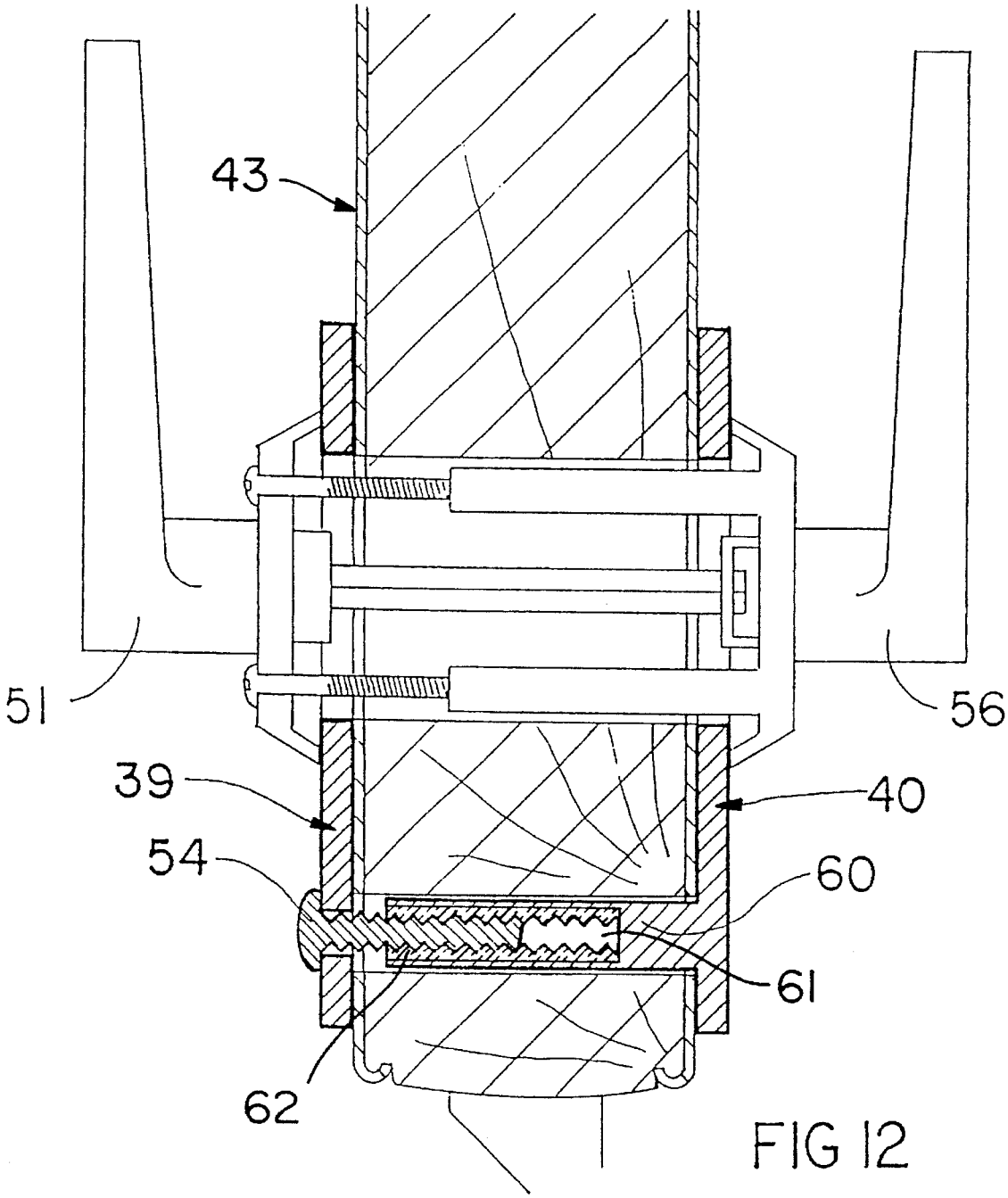
FIG. 12 is a horizontal cross-section taken along lines 12—12 of FIG. 1 and illustrating the tightening of the twin plates against the door, in use.
Figure 12A:
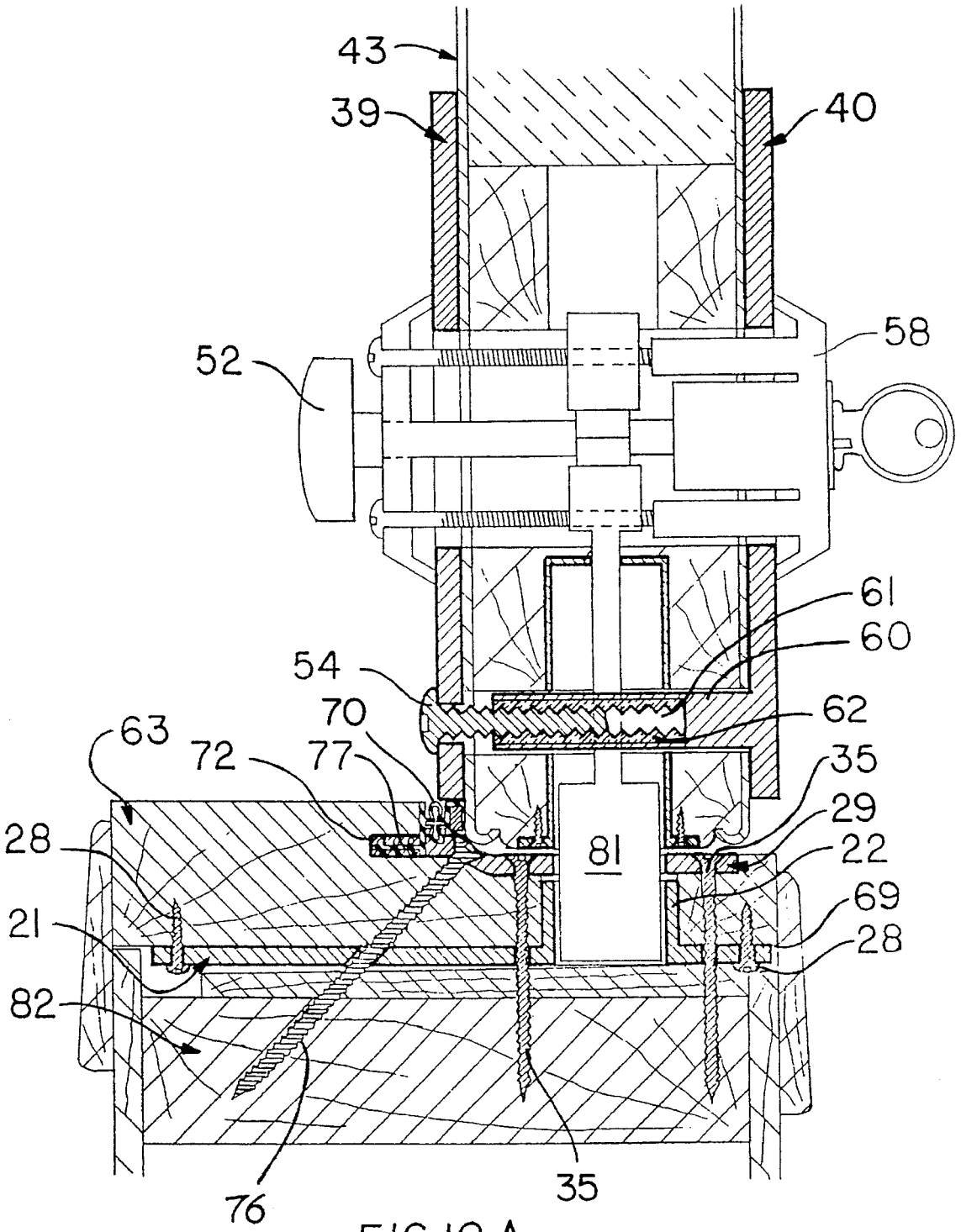
FIG. 12A is a horizontal cross-section taken along lines 12–12A of FIG. 11, further provided with elements of the first and second embodiments in accordance with the present invention of FIG. 5.

The S-shaped plate 29 can be used alone, for instance, in the cases wherein a door latch is added to a steel door for which the frame 63 has already been installed to the building (FIG. 12A). The S-shaped plate 29 adds to the door frame an additional rigidity by reducing the lateral flexibility of the door frame at its center. The mounting screws 76 are deeply anchored in the wooden door frame thereby providing an added rigidity to the door frame as they neutralize the suppleness of the wood fibers under a lateral flexion. Moreover, by introducing the appendix or tail 83 in the door frame 63 in such a way as to take up the space of the anchor or hook 77 of the weather-strip 70, the S-shaped plate 29 increases the level of its resistance.

In the elbow section 33 of the S-shaped plate 29, the two mounting screws 76 are used as elongated anchoring devices extending diagonally through this elbow section 33 (holes 37) so as to reach during the installation of the plate 29 not only the door frame 63 but also a framework 82 of the wall located behind the door frame 63. Acting as a corner, the mounting screws 76 secure the plate 29 against the door frame 63 and to the wall. A certain flexibility of the S-shaped plate 29 allows it to make the most of its reach between the ends thereof from the collar 38 of the bolt 81, through the elbow section 33 adapted to be secured to the framework 82 of the wall, and right up to the extension or tail 83 of the elbow section 33, parallel to the plane of the collar 38 and located in the groove 72 which normally receives a section of the weather strip 70.

The installation on the door frame 63 (FIG. 1) of the combination of the plates 21 and 29 is achieved by fixing the S-shaped plate 29 acting as a striking plate 64 against the wooden door frame 63 in a hollowness 65 defined at a regulation distance from the doorstep, the position of the collar 22 being identical and thus coinciding with the position of the oval hole 38 of the S-shaped plate 29 in position 64 in the hollowness 65. The S-shaped plate 29 is fixed by way of the screws 35 (FIG. 2A) and must be positioned flush with the surface of the door frame 63. To do so, a knife is used to cut the wood of the door frame 63 along the outline 73 of the S-shaped plate 29 and the door frame 63 is then recessed using a wood chisel and in view of the thickness 30 of the S-shaped plate 29. Then, the oval hole 68 is drilled in the door frame 63, this hole 68 having to open onto an exterior surface 69 of the door frame 63 (FIG. 12A). The next step consists in applying the plate 21 on the exterior surface 69 (FIG. 1) of the door frame 63 by sliding the collar 22 in the previously drilled oval hole 68. Finally, the screws 28 are threaded in the door frame 63, through the seven holes 27 intended therefor. If nevertheless the screws 35 (FIG. 12A) of the S-shaped plate 29 are longer than 1.5 cm, it is then necessary to drill the door frame 63 through the plate 21 for allowing the plates 21 and 29 to be screwed one to the other, these plates thus forming an interdependent unit.

The combination of the plate 21 screwed to the S-shaped plate 29 (FIG. 1) at the position of the striking plate 64 compresses the wood of the door frame 63 and provides the same with a high resistance to lateral flexion and guards against an eventual weakness of the door frame 63 at the level of the latch, since the plate 21 is threaded to a large surface on the door frame 63, the S-shaped plate 29 being screwed to the plate 21 and being also diagonally screwed to the framework 82 using the screws 76 and 35 (FIG. 12A). Moreover, the collar 22 of the plate 21 renders the latch inaccessible to anyone who would try to dismantle the door frame 63 at the level of the latch. This is advantageous whether the door opens towards the exterior or the interior. Finally, the combination of the S-shaped plate 29 with the plate 21 is invisible and thus aesthetic.

To install the twin plates 39 and 40, and in the case wherein the door 43 is provided with a handle 51 and with a latch 52, it is necessary to remove these last two components (FIG. 11). If this is not the case, the location of installation of the handle 51 and latch 52 must be established. For doing so, reference must be made to the manufacturer's installation instructions provided with the handles. However, it must be ensured that the distances of the holes of the latch 52 and of the handle 51 are the same for each plate, that is the distance between the centers of the holes 50 and 49 proposed by the manufacturer must coincide with the distance between the centers of the holes of the plates 39 and 40. Then, using the plate 39, the locations 80 (FIG. 11) of drilling of the door 43 must be indicated to allow the pillars 62 to take place therein. To do so, the location of the holes 80 must be at a distance of ⅜ inch approximately from the exterior edge of the door 43. Then, using a drill and a bit of predetermined diameter, the four holes 80 are drilled from one side to the other of the door 43. The pillars 60 of the plate 40 are then introduced in the holes 80 with the plate 40 abutting the exterior surface 42 of the door 43. The plate 39 is applied on the interior surface 41 of the door 43 and the screws 54 are threaded through the holes 53 and into the threaded sleeves 62 of the pillars 60. Finally, the handle 51 and the latch 52 are mounted in the holes 49 and 50 with the collars thereof being applied on the respective plates 39 and 40, and around the holes 49 and 50.

The twin plates 39 and 40 are intended, for instance, for light metal doors doubled with wood when a supplemental door latch is added. The twin plates 39 and 40 have the distinctive characteristics of being joined together by the screws 54 and the threaded tubes 60 through the door 43. Moreover, the twin plates 39 and 40 allow for the latch 52 and the handle 51,56 to form a whole. This unit provides the light metal door with an added resistance to torsion and to break down if it is assaulted by an intruder. Furthermore, the various finishes of the twin plates 39 and 40 allow the unit to harmonize with those of the various handles and latches available on the market.

The joint use of the plate 21 having the projecting collar 22 and the twin plates 39 and 40 can be possible, for instance, when a new set of double wooden doors is installed on a building, that is to say two doors within the same door frame, the interior door including all three plates 21, 39 and 40. This joint use offers a same rigidity efficiency as that of a steel door provided with twin plates 39 and 40, with a wooden door frame reinforced with the plate 21. This structure provides rigidity at the location of the door frame which has the most lateral flexibility, that is at its center, and it also provides rigidity to the door against break down.

Figure 10:
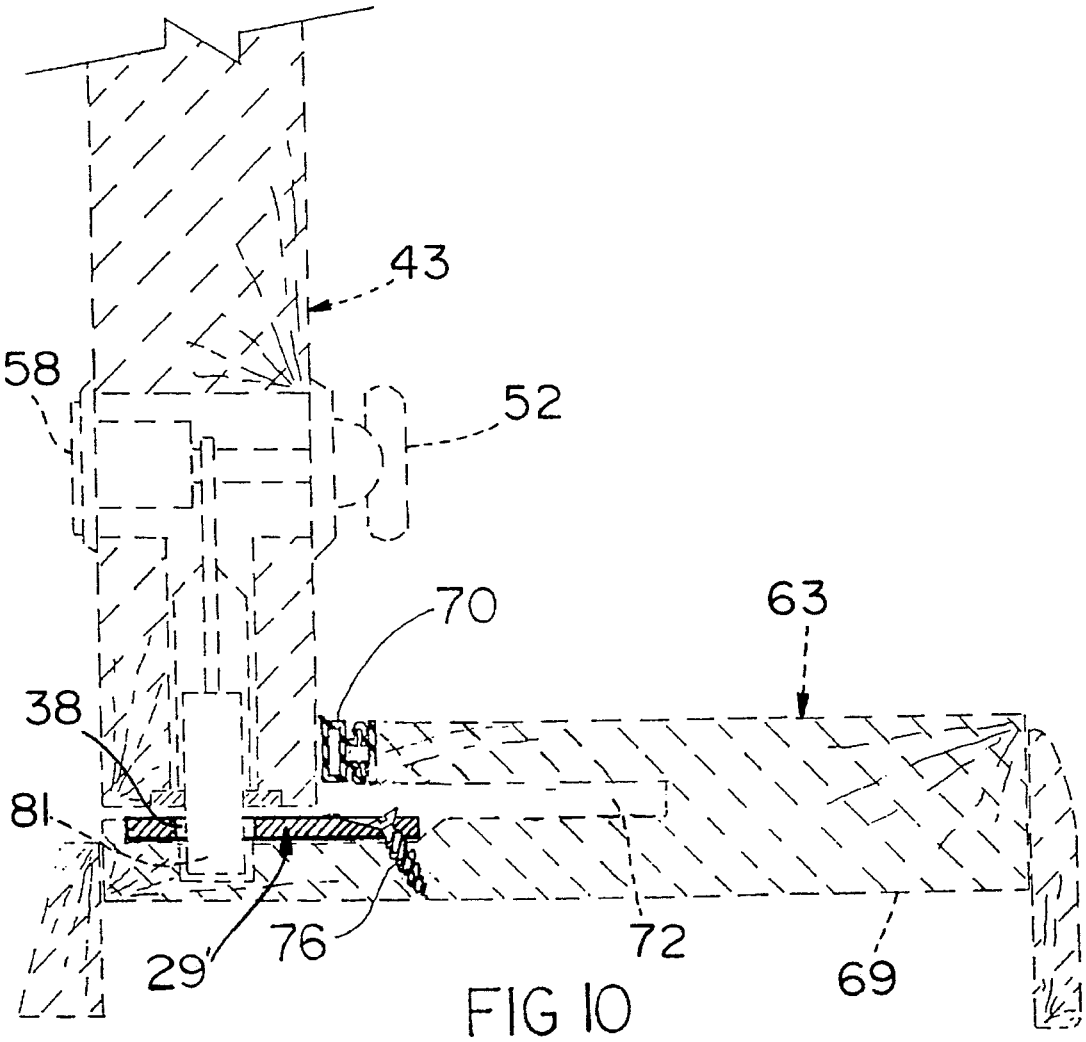
FIG. 10 is a horizontal cross-section taken along lines 10—10 of FIG. 7 but illustrating a variant of the S-shaped plate in position on a door frame.

Now referring to FIG. 10, a variant 29' of the S-shaped plate 29 is designed with substantially no tail portion 83 as long as the mounting screws 76 can be diagonally threaded through the door frame 63 and in the framework 82. In such a case, the plate 29' does not extend in the groove 72. This construction might be required in door frames having no such groove 72. The S-shaped plate could also be substantially flat (see FIG. 10) especially in the above case of plate 29' wherein the tail end thereof is not received in a groove such as groove 72.

Figure 13A:
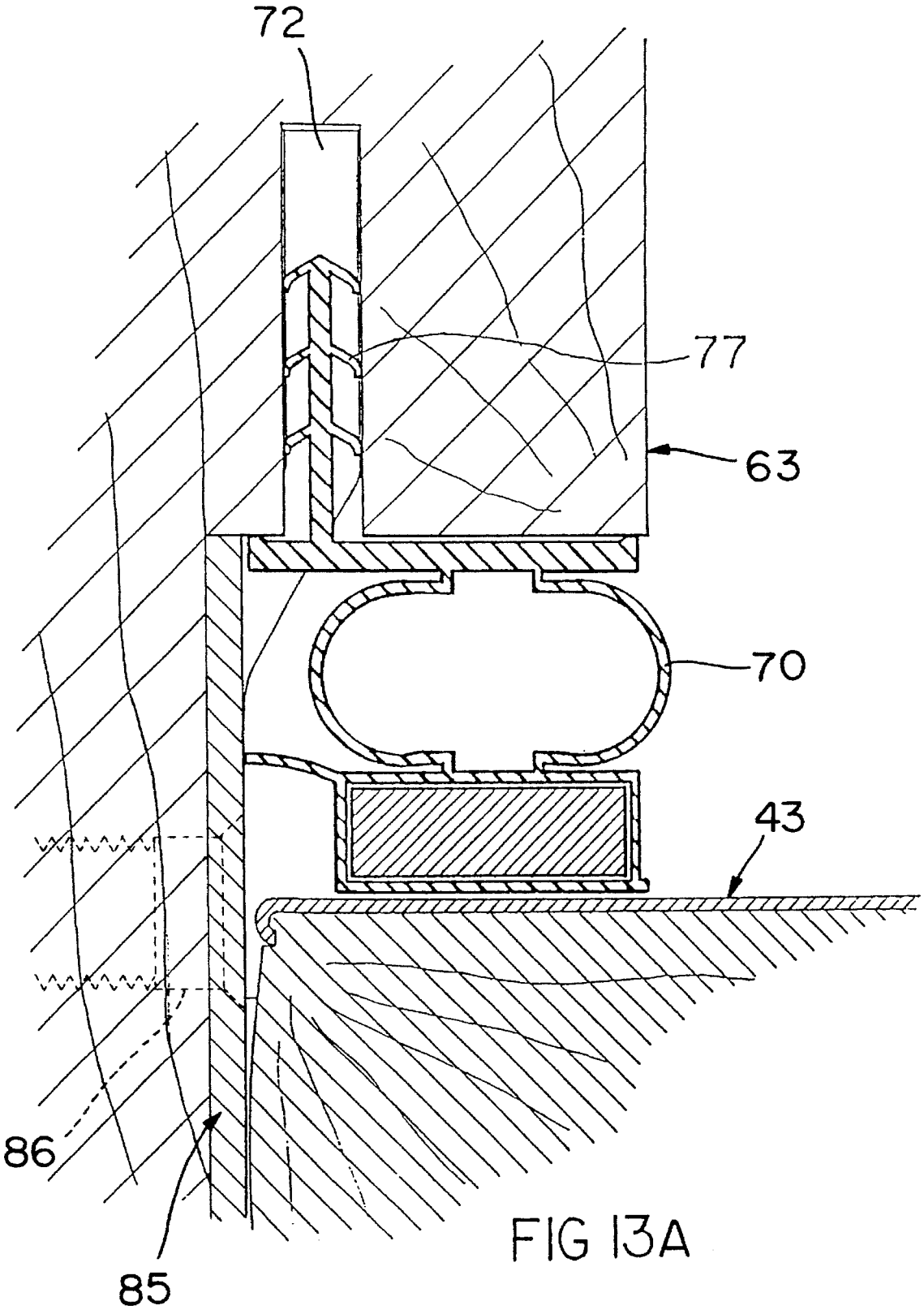
FIG. 13A is a horizontal cross-section taken along lines 13A—13A of FIG. 1 and illustrating a plate for reinforcing a door frame at a live bolt in accordance with a fourth embodiment of the present invention.

Now referring to FIGS. 1, 13A and 15, a further embodiment of the present invention takes the form of a further variant of the S-shaped plate 29, wherein a plate 85 intended for the live bolt of the handle 51,56 (instead of for the dead bolt of the latch 52 as is normally the case for the plate 29) has a rear extension similar to that of the plate 29' of FIG. 10. Two additional screws 86 are mounted through this rear extension and into the door frame 63 and into the framework 82. Screws 87 correspond to the standard screws for mounting a conventional plate of a live bolt of a handle which the reinforced plate 85 replaces herein.

I claim:

1. A reinforcement device for a door, the door comprising interior and exterior parallel surfaces and also comprising at least one door control device of at least one bolt, dead or live, the bolt extending through a side of the door joining the two previous parallel surfaces thereof, said reinforcement device comprising a pair of distinct inner and outer reinforcing plates having inner flat sides adapted to be positioned substantially opposite one to the other respectively on the interior and exterior surfaces of the door and close to the side of the door carrying the bolt, each one of said plates defining at least a first opening intended to receive the control device of the bolt, mounting means being provided for connecting said plates together, said mounting means for extending through the door substantially along the thickness thereof, said reinforcement device thus reinforcing the door at least around the bolt; wherein said mounting means comprise at least one element mounted to said outer plate, said element extending towards said inner plate and adjacent thereto, and attachment means adapted to connect said inner plate to said element with said element and said attachment means for being at least partly received in at least a second opening defined substantially transversely in the door in such a way that said attachment means urge said inner plate towards said element, thermal break means being provided between said inner plate and said outer plate.

2. A reinforcement device as defined in claim 1, wherein at least two elements are provided each comprising a bored pillar disposed substantially at right angles with respect to said outer plate, said attachment means being adapted for joining said inner plate to said bored pillar, said thermal break means being provided between said inner plate and said bored pillar.

3. A reinforcement device as defined in claim 2, wherein said thermal break means comprise for each said bored pillar an inner thermally insulating sleeve located in said bored pillar such as to extend between said bored pillar and said attachment means thereby thermally insulating said attachment means from said bored pillar.

4. A reinforcement device as defined in claim 3, wherein said attachment means are inaccessible from the exterior surface of the door and comprise a screw for each said pillar, said screw extending through a third opening defined in said inner plate and having a head restrained by a portion of said inner plate surrounding at at least partly said third opening, said screw having threads adapted to engage said sleeve in said bored pillar.

5. A reinforcement device as defined in claim 4, wherein said bored pillar is substantially integral to said outer plate, and wherein there is a corresponding number of bored pillars, of second openings and of third openings.

6. A reinforcement device as defined in claim 5, wherein at least some of said bored pillars are disposed in a spaced apart relationship closer to a first edge of said outer plate located at proximity of the side of the door carrying the bolt than to a second edge of said outer plate located opposite said first edge thereof, said some of said bored pillars being located inwardly of said edge of said outer plate and outwardly of said first opening thereof.

7. A reinforcement device as defined in claim 1, wherein the door comprises two control devices each controlling a bolt, that is one live bolt and one dead bolt belonging respectively to a handle and to a latch, the handle and the latch comprising collars adapted to abut, when installed, against said inner and outer plates around said first openings, the collars thus acting in compression on said plates.

8. A reinforcement device as defined in claim 1 and also comprising means for reinforcing the door frame at the level of the bolt of the door, said door frame reinforcing means comprising a substantially oval collar and a plate adapted to be mounted on an exterior surface of the door frame before the door frame is installed within an opening of a wall, said plate being interdependent of said collar, said collar being adapted to extend through the door frame and being adapted for receiving the bolt, said collar acting jointly with the bolt for resisting to the shearing of the bolt submitted to an impact against the door frame.

9. A reinforcement device for a door frame, the door frame being located inside of an opening defined in a wail, a location for a striking plate being provided on a surface of the door frame facing a door when the latter is closed, the surface being adapted for receiving at least a bolt of the door, said reinforcement device comprising a plate adapted to be secured against the surface of the door frame at least partly at said location, said plate defining an opening adapted for surrounding the bolt, securing means being provided for securing said plate to the door frame, said securing means being adapted for being directed at right angles in the aforementioned surface of the door frame, said reinforcement device being characterized in that said plate comprises an extension adapted for extending substantially at least up to a section of the door frame where intersect a first plane of a first surface of the door frame defining the location of the striking plate and a second plane of a second surface of the door frame which limits the displacement of the door when it is in its closed position, said extension being thus adapted to extend from the location of the striking plate at least up to said second plane, said extension defining an elbow section and a free end section extendable in a third plane parallel to but spaced from said first plane, the door frame defining a groove in said third plane for being coplanar to said free end section and offset from said first plane.

10. A reinforcement device as defined in claim 9, wherein said groove is defined in the second surface of the door frame and is adapted for receiving an anchor of a weather-strip, said free end section of said extension by way of said elbow section being adapted to extend at least partly into said groove, anchoring means being provided for extending through said elbow section at an angle with respect to both said first and second planes and at least partly into the door frame.

11. A reinforcement device as defined in claim 10, wherein there are two said anchoring means which are vertically spaced apart one from the other.

12. A reinforcement device as defined in claim 10, wherein said anchoring means comprise screws which are long enough to reach a framework of the wall.

13. A reinforcement device as defined in claim 10, wherein said anchoring means extend at an angle through said elbow section for extending through the door frame in such a way as to finally become anchored in a framework of the wall, thus rendering the door frame substantially interdependent of the wall.

14. A reinforcement device as defined in claim 13, wherein sections of said plate located on one side and the other of said elbow section extend substantially parallel, and wherein said elbow section is adapted to be located adjacent to the groove and substantially opposite an edge of the door located closest to the second surface when door is closed.

15. A reinforcement device as defined in claim 13, wherein said free end section of said extension is dimensioned so that a section of the anchor of the weather-strip intended for the groove defined in the door frame is removed prior to the installation of said plate on the door frame.

16. A reinforcement device as defined in claim 9 further comprising a second plate and a substantially oval collar extending from said second plate, said second plate being adapted for being mounted on an exterior surface of the door frame prior to the installation of this door frame inside the opening defined in the wall in such a way that said collar projects from said second plate in the direction of said plate and extends at least partly through the door frame, said collar being adapted to receive a bolt of the door when the latter is closed, thereby reinforcing the door frame.

17. A reinforcement device as defined in claim 16, wherein said collar is disposed at right angles with respect to said second plate and extends at least close to said plate; and wherein said second plate is secured to the door frame by way of screws.

18. A reinforcement device for a door frame, the door frame being located inside of an opening defined in a wall, a location for a striking plate being provided on a surface of the door frame facing a door when the latter is closed, the surface being adapted for receiving at least a bolt of the door, said reinforcement device comprising a plate adapted to be secured against the surface of the door frame at least partly at said location, said plate defining an opening adapted for surrounding the bolt, securing means being provided for securing said plate to the door frame, said securing means being adapted for being directed at right angles in the aforementioned surface of the door frame, the door frame having a first surface defining the location of the striking plate which joins a second surface thereof which limits the displacement of the door when it is displaced towards its closed position, a groove being defined in this second surface of the door frame, said reinforcement device being characterized in that said plate comprises an extension adapted to extend at least partly into the groove previously mentioned, anchoring means being provided for extending through said extension and at least into the door frame, wherein a plane of the groove is offset with respect to a plane of the surface of the door frame, said extension comprising an elbow section for allowing the insertion of a free end of said extension into the groove, said elbow section being adapted to be located adjacent to the groove and substantially opposite an edge of the door located closest to the second surface when the door is closed.

19. A reinforcement device as defined in claim 18, wherein said anchoring means extend through said elbow section of said extension and at acute angles with respect to both the first and second surfaces of the door frame.

20. A reinforcement device as defined in claim 18 further comprising a second plate and a substantially oval collar extending from said second plate, said second plate being adapted for being mounted on an exterior surface of the door frame prior to the installation of this door frame inside the opening defined in the wall in such a way that said collar projects from said second plate in the direction of said plate and extends at least partly through the door frame, said collar being adapted to receive a bolt of the door when the latter is closed, thereby reinforcing the door frame.

* * * * *